US011092389B2

(12) United States Patent
Uno et al.

(10) Patent No.: US 11,092,389 B2
(45) Date of Patent: Aug. 17, 2021

(54) HEAT EXCHANGER

(71) Applicant: DENSO CORPORATION, Kariya (JP)

(72) Inventors: Takahiro Uno, Kariya (JP); Takuya Mitsuhashi, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/768,449

(22) PCT Filed: Sep. 6, 2016

(86) PCT No.: PCT/JP2016/076079
§ 371 (c)(1),
(2) Date: Apr. 13, 2018

(87) PCT Pub. No.: WO2017/064940
PCT Pub. Date: Apr. 20, 2017

(65) Prior Publication Data

US 2018/0320995 A1 Nov. 8, 2018

(30) Foreign Application Priority Data

Oct. 15, 2015 (JP) ..... JP2015-203907

(51) Int. Cl.
*F28F 9/02* (2006.01)
*F28F 9/18* (2006.01)
*F28D 1/053* (2006.01)

(52) U.S. Cl.
CPC ..... *F28F 9/0226* (2013.01); *F28D 1/05366* (2013.01); *F28F 9/18* (2013.01);
(Continued)

(58) Field of Classification Search
CPC ..... F28F 2225/08; F28F 9/18; F28F 9/182; F28F 9/185; F28F 9/0224
See application file for complete search history.

(56) References Cited

U.S. PATENT DOCUMENTS 4,582,127 A * 4/1986 Moranne ..... F28F 9/0226 165/173
5,664,625 A * 9/1997 Letrange ..... F28F 9/02 165/149

(Continued)

FOREIGN PATENT DOCUMENTS

DE 102008033594 A1 * 2/2009 ..... F28F 9/02
DE 102013217689 A1 3/2015

(Continued)

*Primary Examiner* — Joel M Attey
*Assistant Examiner* — For K Ling
(74) *Attorney, Agent, or Firm* — Hamess, Dickey & Pierce, P.L.C.

(57) ABSTRACT

A heat exchanger includes tubes and a header tank. The header tank includes a core plate and a tank body. The core plate includes a tube connection surface and a receiving portion that houses an end portion of the tank body. The receiving portion includes a bottom wall and an inner wall that connects the bottom wall to the tube connection surface. The tube connection surface and the inner wall are connected to a rib. The rib is located between adjacent two tubes and inclined with respect to a longitudinal direction of the tubes. The rib includes one end connected to the tube connection surface and an other end connected to the inner wall. The tubes includes lateral ends in the width direction, and a clearance, which has a specified dimension, is defined between the inner wall and the lateral ends in the width direction.

4 Claims, 12 Drawing Sheets

(52) U.S. Cl.
CPC ..... *F28F 9/182* (2013.01); *F28F 2225/02* (2013.01); *F28F 2225/08* (2013.01); *F28F 2265/26* (2013.01)

(56) References Cited

U.S. PATENT DOCUMENTS

| | | | | |
|---|---|---|---|---|
| 5,816,316 | A * | 10/1998 | Hoffnung | F28F 9/0224 165/76 |
| 8,181,694 | B2 | 5/2012 | Powers et al. | |
| 10,101,096 | B2 * | 10/2018 | Honma | F28F 9/0224 |
| 2006/0254761 | A1 * | 11/2006 | Watanabe | B23K 1/0012 165/173 |
| 2008/0000626 | A1 | 1/2008 | Sugito et al. | |
| 2009/0255657 | A1 * | 10/2009 | Hakamata | F28F 9/0226 165/178 |
| 2011/0139424 | A1 * | 6/2011 | Bensel | F28F 9/04 165/173 |
| 2014/0174702 | A1 * | 6/2014 | Kurz | F28F 9/0224 165/165 |
| 2016/0187077 | A1 | 6/2016 | Heine et al. | |
| 2017/0038163 | A1 | 2/2017 | Hakamata et al. | |

FOREIGN PATENT DOCUMENTS

| | | | |
|---|---|---|---|
| JP | 2008032384 | A | 2/2008 |
| JP | 2014519005 | A | 8/2014 |
| JP | 2015127631 | A | 7/2015 |
| WO | WO-2011061085 | A1 | 5/2011 |
| WO | WO-2014180865 | A1 | 11/2014 |
| WO | WO-2017013918 | A1 | 1/2017 |

* cited by examiner

HEAT EXCHANGER

CROSS REFERENCE TO RELATED APPLICATIONS

This application is a U.S. National Phase Application under 35 U.S.C. 371 of International Application No. PCT/JP2016/076079 filed on Sep. 6, 2016 and published in Japanese as WO 2017/064940 A1 on Apr. 20, 2017. This application is based on and claims the benefit of priority from Japanese Patent Application No. 2015-203907 filed on Oct. 15, 2015. The entire disclosures of all of the above applications are incorporated herein by reference.

TECHNICAL FIELD

The present disclosure relates to a heat exchanger.

BACKGROUND ART

A heat exchanger such as a radiator includes a core and a header tank. The core is configured by tubes and corrugated fins stacked alternately with each other. The tubes include longitudinal ends that are attached to the header tank, thereby being in communication with the header tank. The header tank includes a core plate and a tank body. The tubes are inserted into the core plate and coupled with the core plate. The tank body defines an internal space of the header tank therein together with the core plate. The core plate includes a tube connection surface and a receiving portion. The tube connection surface includes tube insertion holes into which the longitudinal ends of the tubes are inserted. The tube connection surface includes an outer periphery provided with the receiving portion. The receiving portion receives an end portion of the tank body. In the heat exchanger, a temperature difference occurs between adjacent two tubes of the tubes due to a flow rate distribution of a cooling water flowing through the tubes and an outside air (i.e., cooling air). As a result, the tube connection surface of the core plate is deformed due to the temperature difference, and stress is concentrated to an end portion of the core plate in a width direction of the tubes.

Then, it is considered to provide a rib in an area adjacent to the end portion of the core plate (for example, refer to Patent Literature 1). Patent Literature 1 discloses a heat exchanger includes a tube connection surface provided with a rib to suppress a deformation of an end portion of the core plate in a width direction of tubes. By providing the rib, stress, which is caused around the end portion of the core plate, is distributed to an edge of the rib, therefore the stress can be reduced.

PRIOR ART LITERATURES

Patent Literature

Patent Literature 1: JP 2008-32384 A

SUMMARY OF INVENTION

However, according to the heat exchanger of Patent Literature 1, a space, which is required to distribute the stress to the edge of the rib in the tube connection surface of the core plate, may not be defined sufficiently when a dimension between the tubes and the receiving portion of the core plate is small. When the space is insufficient, the stress may increase rapidly in a connection area where the core plate and the tubes are coupled. Therefore, it may be hard to reduce a size of the heat exchanger in the width direction and to reduce the stress in the tube connection surface of the core plate at the same time.

The present disclosure addresses the above issues, thus it is an objective of the present disclosure to provide a heat exchanger that enables to shorten a length thereof in a width direction and to reduce a thermal stress in a connection area where a core plate and tubes are coupled.

According to an aspect of the present disclosure, a heat exchanger includes tubes and a header tank. The tubes are stacked and have a flat shape. The header tank is positioned on a side of the tubes in a longitudinal direction of the tubes. The header tank is in communication with the tubes. The header tank includes a core plate and a tank body. The core plate is coupled with longitudinal ends of the tubes. The tank body is fixed to the core plate. The core plate includes a tube connection surface and a receiving portion. The tube connection surface includes tube insertion holes corresponding to the plurality of tubes. The tubes are inserted into the tube insertion holes and brazed to the tube connection surface. The receiving portion surrounds the tube connection surface and houses an end portion of the tank body which is located adjacent to the core plate. The receiving portion includes a bottom wall and an inner wall. The bottom wall faces the tank body across a sealing member. The inner wall connects the bottom wall to the tube connection surface. The tube connection surface and the inner wall are connected to a rib, which is located between adjacent two tubes of the tubes and inclined with respect to the longitudinal direction. The rib includes one end and an other end facing each other in a width direction of the tubes. The one end is connected to the tube connection surface, and the other end is connected to the inner wall. The other end of the rib is connected to a portion of the inner wall which is located between one end and an other end of the inner wall in the longitudinal direction.

The core plate includes a connection area where the core plate and lateral ends of the tubes in a width direction (i.e., a tube width direction). The core plate receives stress in the connection area concentrically therefore the core plate is deformed in the connection area easily. Then, by connecting the rib to the inner wall of the receiving portion such that the rib inclines with respect to the inner wall, the stress is distributed to an edge of the rib. Therefore the deformation of the core plate around the connection area can be suppressed. On the other hand, when the rib is formed to extend continuously along the tube connection surface in the width direction (i.e., the tube width direction), stiffness across the core plate is increased in the tube width direction. As a result, the core plate is hardly defamed in the longitudinal direction of the tubes. Thus, effect of reducing the stress applied to a lateral end of the core plate, which is an end of the core plate in the tube width direction, may deteriorate, and the stress may be applied across the core plate in the tube width direction. Then, by connecting the one end of the rib to the portion of tube connection surface which is located between the one end and the other end of the inner wall in the longitudinal direction, an increase of stiffness of the core plate is suppressed, and the deformation of the core plate around a periphery of the connection area in the tube width direction is suppressed. Therefore, a stress concentration in the periphery of the connection area where the tubes are connected to the core plate can be reduced. Furthermore, when a distance between the receiving portion of the core plate and the tubes is decreased, a distance between the edge of the rib and a portion of the core plate where lateral ends of the tubes in the tube width direction are connected to the core plate is decreased. Therefore, the stress can be distributed to the edge of the rib effectively. Thus, the inner wall of the receiving portion can be located adjacent to the tubes, and a size of the heat exchanger in the width direction can be reduced.

BRIEF DESCRIPTION OF DRAWINGS

The above and other objects, features and advantages of the present disclosure will become more apparent from the following detailed description made with reference to the accompanying drawings.

DESCRIPTION OF EMBODIMENTS

An embodiment of the present disclosure will be described hereafter referring to drawings. A heat exchanger of the present disclosure effectively performs as a heat exchanger for a vehicle. In the present embodiment, the heat exchanger is a radiator 1 that cools an internal combustion engine (not shown) mounted to a vehicle.

Figure 1:
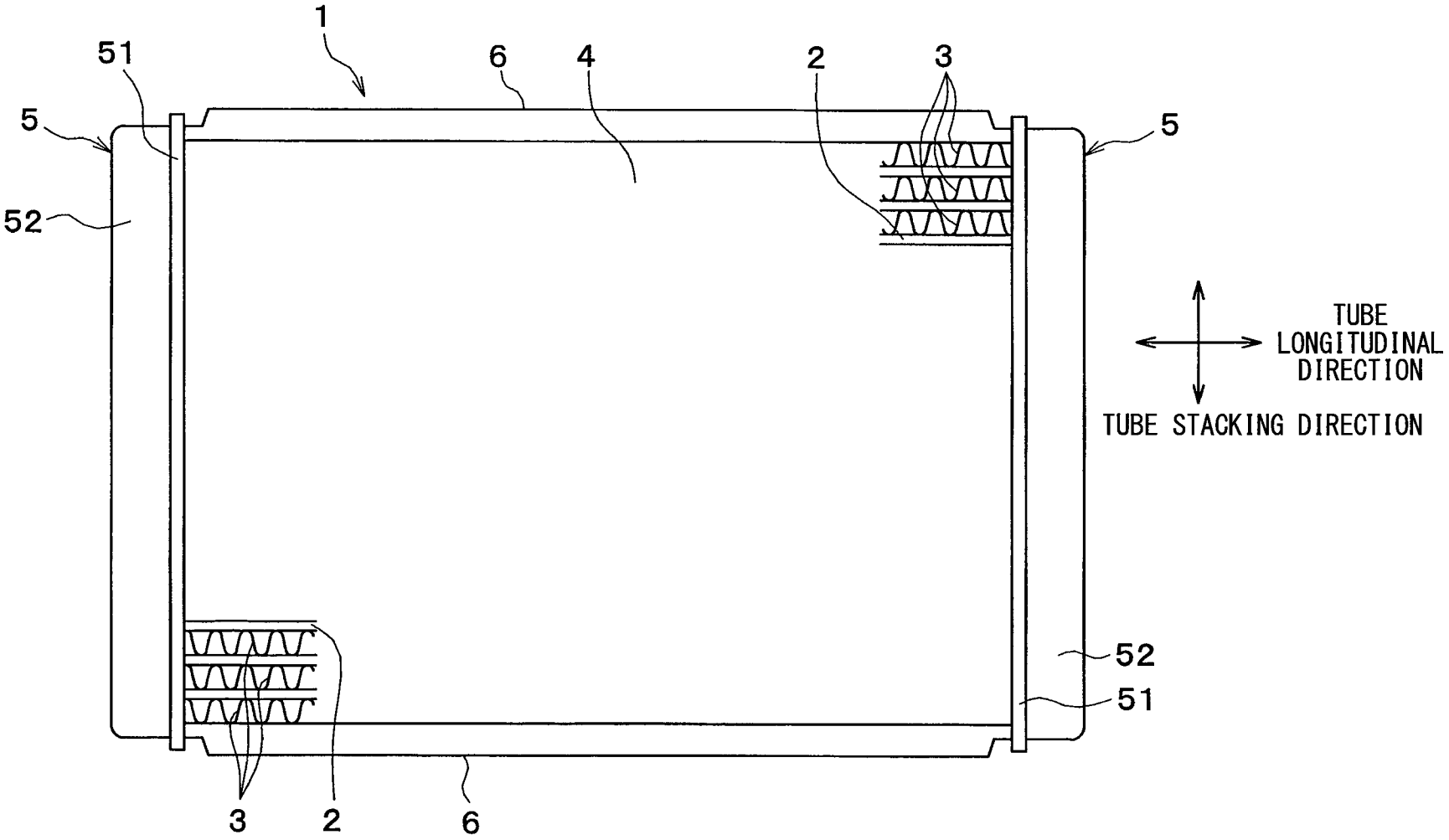
FIG. 1 is a schematic front view of a radiator according to an embodiment.

As shown in FIG. 1, the radiator 1 includes a core 4 serving as a heat exchanging portion that performs a heat exchange between the cooling water and an outside air. The core 4 is a stacked body in which tubes 2 and fins 3 are stacked in an up-down direction. Hereinafter, the tubes 2 will be collectively referred to as the tube 2 and the fins 3 will be collectively referred to as the fin 3. The tube 2 means one of the tubes 2, and the one and the others have the same structure. The fin 3 means one of the fins 3, and the one and the others have the same structure.

Each of the tubes 2 is a tubular member and defines a passage therein through which the cooling water cooling the internal combustion engine flows. The tubes 2 extend such that a longitudinal direction of the tubes 2 is parallel with a horizontal direction. The tubes 2 have a flat shape in a cross section perpendicular to the longitudinal direction. In the cross section, a major radius direction is parallel with a flow direction of air passing through the core 4. For example, the flat shape is a ellipse shape that is a curved shape formed by combining an arc having a large curvature radius and an arc having a small curvature radius. Alternatively, the flat shape may be an oval shape formed by combining an arc and a flat portion.

The major direction of the tubes will be referred to as a tube width direction, and a direction (i.e., the longitudinal direction) along which the tube 2 extends will be referred to as a tube longitudinal direction. A direction in which the tubes 2 and the fins 3 are stacked will be referred to as a tube stacking direction. In the present embodiment, the tube width direction is perpendicular to both the tube longitudinal direction and the tube stacking direction.

The fin 3 increases a heat transferring area where the heat exchange between the outside air and the cooling water is performed, thereby promoting the heat exchange between the outside air and the cooling water. The tube 2 has one flat surface and an other flat surface facing each other in the stacking direction, and each of the one and other flat surfaces is coupled with the fin 3. The fin 3 has a corrugated shape.

The tube 2 and the fin 3 are made of metal such as an aluminum alloy that has great heat conductivity and great resistance to corrosion. The tube 2, the fin 3, a core plate 51 and a side plate 6 are integrally coupled with each other by a brazing material that is applied to specified areas of the tube 2, the fin 3, the core plate 51 and the side plate 6.

The tube 2 includes one longitudinal end and an other longitudinal end facing each other in the longitudinal direction. The one and the other longitudinal ends are attached to a pair of header tanks 5 that extend in the tube stacking direction and define internal spaces therein. The header tank 5 includes the core plate 51 and a tank body 52. The tubes 2 are inserted into the core plate 51 and coupled with the core plate 51. The tank body 52 defines a tank chamber therein together with the core plate 51. The core plate 51 includes tube insertion holes 511*a*. The header tank 5 is coupled with the core plate 51 while longitudinal ends of the tubes 2 are inserted into the tube insertion holes 511*a*. The passages defined in the tubes 2 are in communication with the tank chamber defined in the header tank 5.

Two side plates 6 are stacked on the core 4 on both sides of the core 4 in the tube stacking direction and reinforce the core 4. The side plates 6 extend along the tube longitudinal direction. Each of the side plates 6 includes one end and an other end facing each other in the tube longitudinal direction and being connected to the core plate 51. The side plates 6 are made of metal such as an aluminum alloy.

Figure 2:
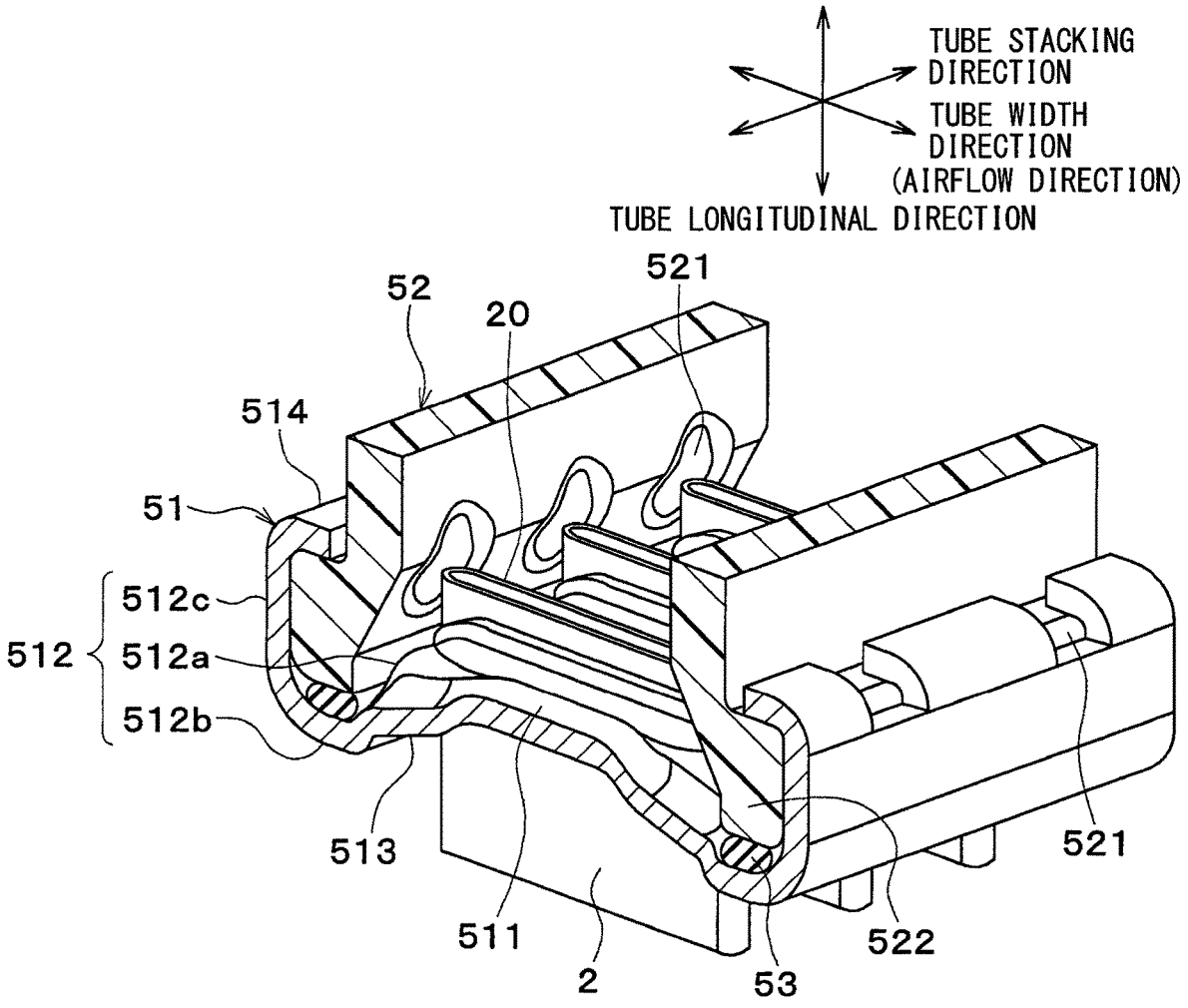
FIG. 2 is an exploded perspective view of a periphery of a header tank of the radiator.
Figure 3:
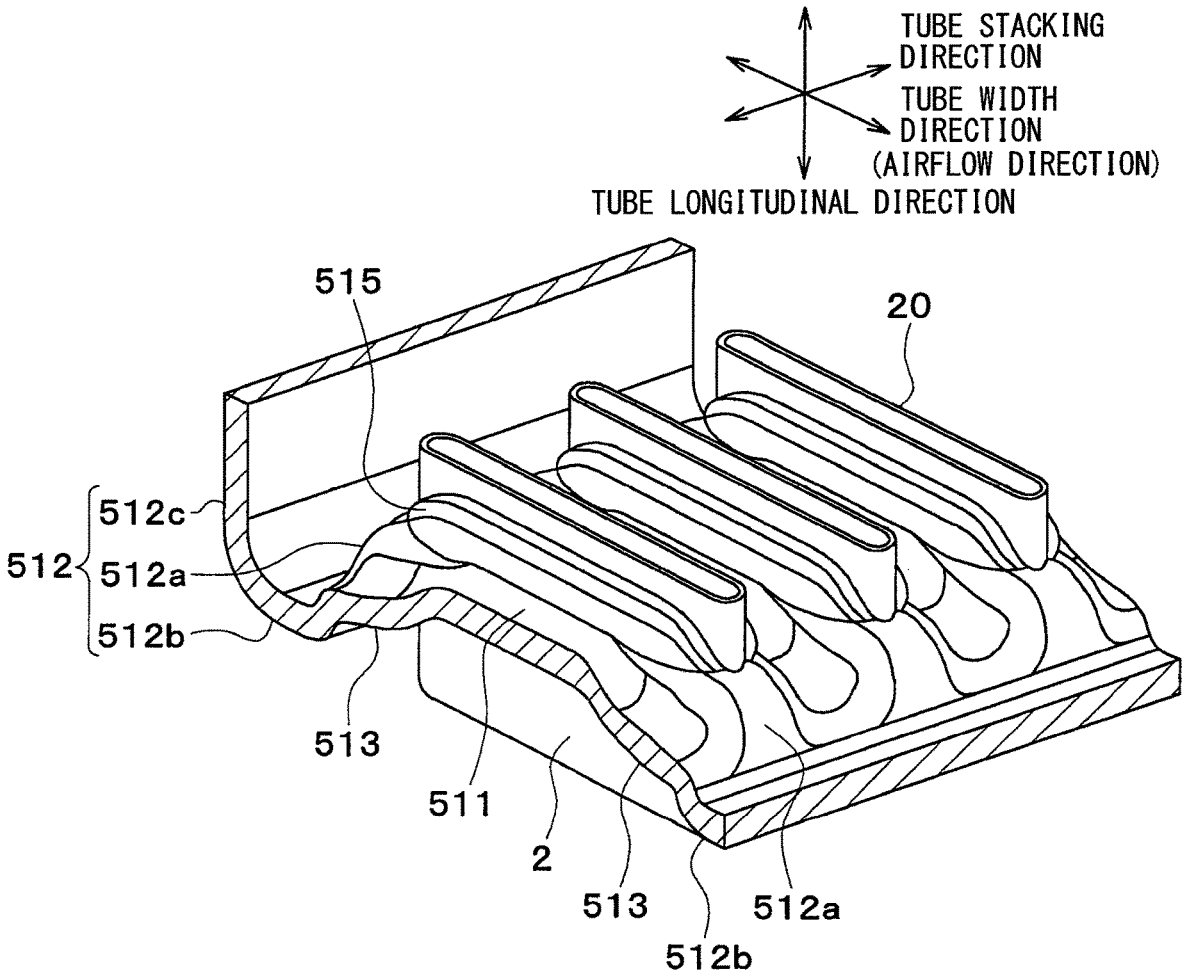
FIG. 3 is an exploded perspective view of a periphery of a core plate of the radiator.

As shown in FIG. 2, the header tank 5 includes the core plate 51, the tank body 52, and a gasket 53. The tubes 2 and the side plates 6 are inserted into the core plate 51 and coupled with the core plate 51. The tank body 52 defines the tank chamber therein together with the core plate 51. The gasket 53 is a sealing member that seals between the core plate 51 and the tank body 52.

The core plate 51 is made of metal such as an aluminum alloy having great heat conductivity and great resistance to corrosion. The tank body 52 is made of resin such as glass-reinforced polyamide that is reinforced by glass fiber. The gasket 53 is made of, for example, silicon rubber or EPDM (ethylene-prophylene-diene rubber).

The core plate 51 includes protrusions 514. Each of the protrusions 514 protrudes from an outer wall 512*c* of the core plate 51 toward the tank body 52. Each of the protrusions 514 is located between adjacent two tubes 2 of the tubes 2, in other words, is located at a position corresponding to a flange 522 (i.e., an end portion) of the tank body 52.

The core plate 51 and the tank body 52 are fixed to each other by deforming the core plate 51 plastically. Specifically, the gasket 53 is located between the core plate 51 and the tank body 52, and the protrusions 514 are deformed plastically to press the tank body 52. By deforming the protrusions 514 plastically to hold the flange 522 of the tank body 52, the core plate 51 and the tank body 52 are assembled.

An inner surface of the tank body 52 is located closer to a center of the header tank 5 than a lateral end of the tube 2 in the tube width direction. That is, the inner surface of the tank body 52 is located closer to a center portion of the tube 2 than the lateral end of the tube 2. In other words, the inner surface of the tank body 52 is located between the lateral end of the tube 2 and the center portion of the tube 2 in the tube width direction. A portion of the tank body 52 facing the tube 2 includes a bulge 521 that is recessed toward an outside of the tank body 52. Therefore, the inner surface of the tank body 52 is not in contact with the lateral end of the tube 2.

The flange 522 is connected to a bottom wall 512*b* of the core plate 51 through the gasket 53. That is, the bottom wall 512*b* includes a sealing surface on which the gasket 53 is positioned.

Figure 4:
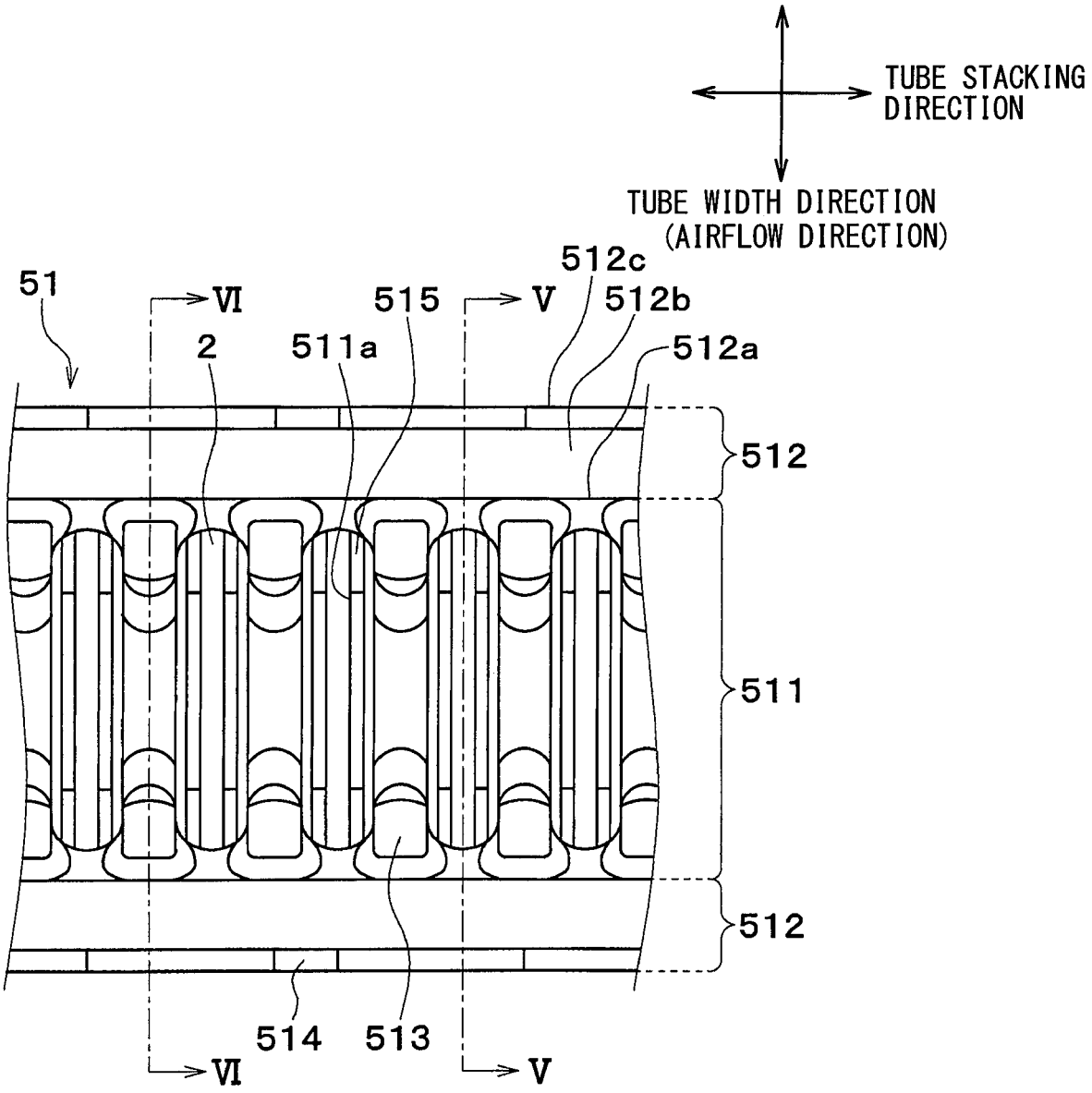
FIG. 4 is a bottom view of the core plate of the radiator.
Figure 5:
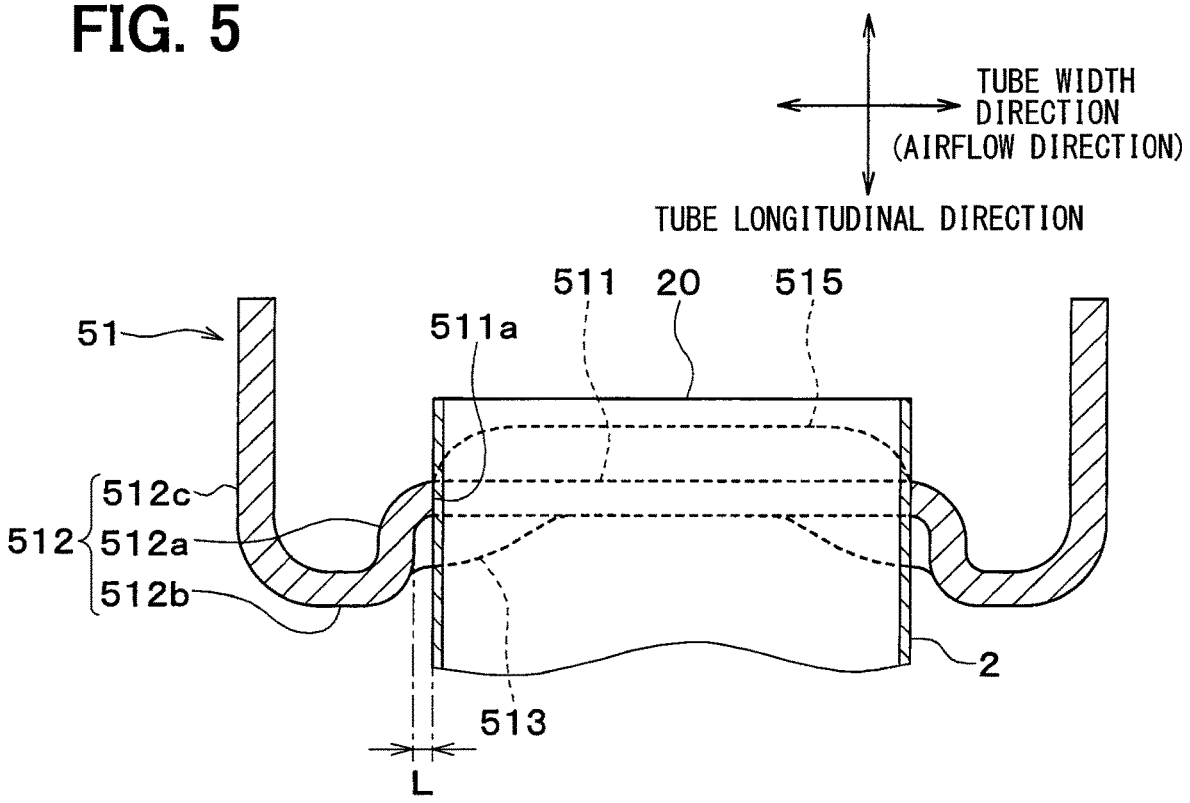
FIG. 5 is a cross-sectional view taken along a line V-V shown in FIG. 4.
Figure 6:
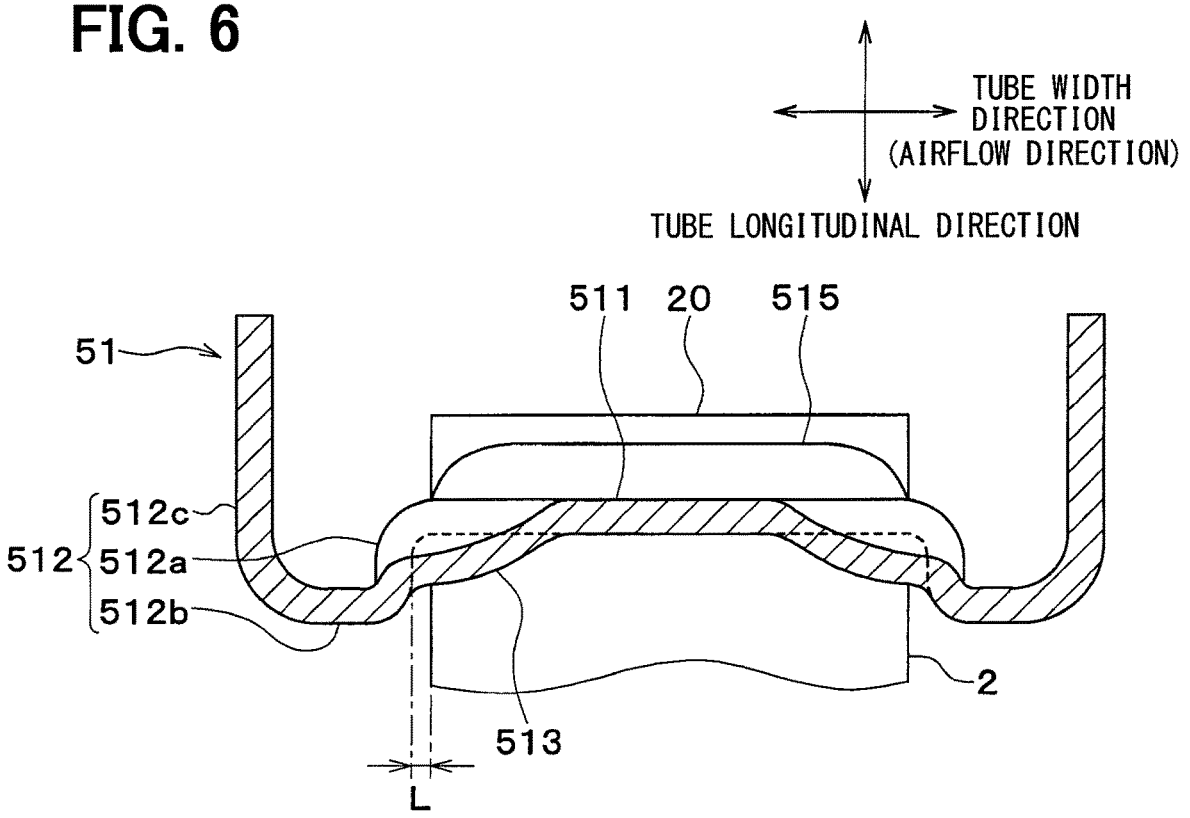
FIG. 6 is a cross-sectional view taken along a line VI-VI.

A configuration of the core plate 51 will be described in detail hereafter referring to FIG. 3 to FIG. 6. As shown in FIG. 4, the tube longitudinal direction is perpendicular to both the tube stacking direction and the tube width direction. As shown in FIG. 5 and FIG. 6, the tube stacking direction is perpendicular to both the tube width direction and the tube longitudinal direction. An illustration of the protrusions 514 is omitted in FIG. 3, FIG. 5 and FIG. 6.

The core plate 51 includes a tube connection surface 511. The tubes 2 are inserted into which the tubes 2 and fixed to the tube connection surface 511. The tube connection surface 511 has a flat surface. The tube connection surface 511 intersects with the tube longitudinal direction and extends along the tube width direction. In the present embodiment, the tube connection surface 511 is perpendicular to the tube longitudinal direction and parallel to the tube width direction.

The tube connection surface 511 includes tube insertion holes 511*a*. The tube insertion holes 511*a* are arranged in the tube stacking direction to be distanced from each other. The longitudinal ends of the tubes 2 (referred to as an tube end 20 hereinafter) are inserted into the tube insertion holes 511*a* and brazed to the tube connection surface 511.

A periphery of the tube connection surface 511 is provided with a receiving portion 512 (i.e., a receiving holder). For example, the receiving portion 512 is a groove extends along the tube connection surface 511. The receiving portion 512 houses the flange 522 of the tank body 52 and the gasket 53. The receiving portion 512 includes the bottom wall 512*b*, the inner wall 512*a* and an outer wall 512*c*. The bottom wall 512*b* extends in the tube width direction. The inner wall 512*a* and the outer wall 512*c* extend in the tube longitudinal direction. The inner wall 512*a*, the bottom wall 512*b* and the outer wall 512*c* are arranged in this order from the tube connection surface 511.

The inner wall 512*a* and the outer wall 512*c* are formed by bending the bottom wall 512*b* in L-shape. The inner wall 512*a* is located closer to the tube 2 than the bottom wall 512*b* in the tube width direction, and the outer wall 512*c* is located further from the tube 2 than the bottom wall 512*b*. In other words, the inner wall 512*a* is located between the bottom wall 512*b* and the tube 2 in the tube width direction, and the bottom wall 512*b* is located between the tube 2 and the outer wall 512*c* in the tube width direction.

The inner wall 512*a* is located on an outer side of the tube 2 in the tube width direction. That is, the receiving portion 512 of the core plate 51 is located on the outer side of the tube 2 in the tube width direction entirely. A clearance having a specified dimension L is defined between the inner wall 512*a* and the lateral end of the tube 2. The lateral end of the tube 2 has an arc shape in a cross section viewed in the tube longitudinal direction. When a tip of the lateral end is defined as a portion 0° (see FIG. 14), the specified dimension L becomes a shortest length between the portion 0° and the inner wall 512*a* in the tube width direction.

The lateral end of the tube 2 is located in the flat surface serving as the tube connection surface 511. Therefore, the core plate 51 extends parallel to the tube width direction in an area where the lateral end of the tube 2 is coupled with the core plate 51.

A distance between the tube connection surface 511 and the tube end 20 in the tube longitudinal direction is different from a distance between the bottom wall 512*b* and the tube end 20 in the tube longitudinal direction. Specifically, the distance between the tube connection surface 511 and the tube end 20 in the tube longitudinal direction is shorter than the distance between the bottom wall 512*b* and the tube end 20 in the tube longitudinal direction. That is, the bottom wall 512*b* is positioned closer to the core 4 than the tube connection surface 511 in the tube longitudinal direction, i.e., positioned further from the tube end 20 than the tube connection surface 511.

A distance between the tube connection surface 511 and the tube end 20 in the tube longitudinal direction is different from a distance between the bottom wall 512*b* and the tube end 20 in the tube longitudinal direction. Specifically, the distance between the tube connection surface 511 and the tube end 20 in the tube longitudinal direction is shorter than the distance between the bottom wall 512*b* and the tube end 20 in the tube longitudinal direction. That is, the bottom wall 512*b* is positioned closer to the core 4 than the tube connection surface 511 in the tube longitudinal direction, i.e., positioned further from the tube end 20 than the tube connection surface 511. In other words, the tube connection surface 511 is located between the bottom wall 512*b* and the tube end 20 in the tube longitudinal direction.

The tube connection surface 511 and the inner wall 512*a* are in connection with a rib 513. The rib 513 is positioned between adjacent two tubes 2 of the tubes, i.e., between adjacent two holes of the tube insertion holes 511*a*. The rib 513 protrudes from a plate surface of the core plate 51. The rib 513 protrudes toward the core 4 in the longitudinal direction, i.e., in a direction away from the tube end 20. The rib 513 improves stiffness of the core plate 51

The rib 513 is inclined with respect to the tube longitudinal direction. The rib 513 is inclined with respect to the tube connection surface 511, i.e., with respect to the tube width direction. The rib 513 is inclined such that a distance between the rib 513 and the tube end 20 increases from the tube connection surface 511 toward the receiving portion 512, i.e., increases as being away from the center portion of the tube 2 in the tube width direction.

The rib 513 extends from the tube connection surface 511 to the inner wall 512*a* in the tube width direction. That is, the rib 513 includes one end and an other end facing each other in the tube width direction. The one end is connected to the tube connection surface 511, and the other end is connected to the inner wall 512*a*. The one end of the rib 513 is, for example, an end located closer to the center portion of the tube in the tube width direction. The other end of the rib 513 is, for example, an end located further from the center portion of the tube in the tube width direction. The rib 513 extends across the lateral end of the tube 2 when viewed in the tube stacking direction.

The other end of the rib 513 is connected to a portion of the inner wall 512*a*, which is located between one end and an other end of the inner wall 512*a* in the tube longitudinal direction. In other words, the other end of the rib 513 is located in the inner wall 512*a* between the one end and the other end of the inner wall 512*a* in the tube longitudinal direction. That is, the other end of the rib 513 is located between a connection portion of the inner wall 512*a* to which the tube connection surface 511 is connected and a connection portion of the inner wall 512*a* to which the bottom wall 512*b* is connected. Therefore, the other end of the rib 513 is located further from the tube end 20 than the tube connection surface 511 and located closer to the tube end 20 than the bottom wall 512*b*. In other words, the tube connection surface 511 is located between the tube end 20 and the other end of the rib 513 in the tube longitudinal direction and located between the bottom wall 512*b* and the tube end 20 in the tube longitudinal direction.

A periphery of the tube insertion hole 511*a* includes a portion extending in the tube width direction and provided with a burring portion 515. The burring portion 515 protrudes toward the tank chamber defined in the header tank 5. The burring portion 515 increases stiffness of the periphery of the tube insertion hole 511*a*.

A manufacturing method of the radiator 1 having the above-described configuration will be described hereafter. The manufacturing method includes preparing parts configuring the radiator 1. Preparing the parts includes molding the core plate 51 including the tube connection surface 511, the receiving portion 512, the protrusions 514 and the rib 513. In the present embodiment, the tube insertion holes 511*a* are formed in the flat surface of the tube connection surface 511 by punching a metal plate (i.e., by a method of punching).

The tube 2, the fin 3, and the side plate 6, which are prepared in preparing the parts, are assembled in the tube stacking direction on a working bench in temporary assembling the core 4.

An assembled body in which the core plate 51 including the tube insertion holes 511*a* is assembled with the core 4 is wrapped by a jig such as a wire. In brazing, the assembled body is placed in a furnace such that elements of the core plate 51 and the core 4 are brazed to each other.

After brazing, the gasket 53 is positioned in the receiving portion 512 of the core plate 51. Subsequently, the flange 522 is positioned in the receiving portion 512, which houses the gasket 53. Then, in fixing the tank body 52 to the core plate 51, the protrusions 514 of the core plate 51 are deformed plastically by a method such as pressing.

The manufacturing method of the radiator 1 is end after a leakage check and a dimensional check. In the leakage check, it is checked whether the parts are brazed certainly and whether the protrusions 514 are plastically deformed certainly.

In the radiator 1 of the present embodiment, the rib 513 of the core plate 51 is inclined with respect to the tube width direction and has the one end connected to the tube connection surface 511 and the other end connected to the inner wall 512*a*. By connecting the rib 513 to the inner wall 512*a* of the receiving portion 512 to be inclined, a deformation of a connection area (i.e., a tube base portion) of the core plate 51 where the tube 2 is connected to the core plate 51 can be suppressed. Therefore, the stress can be distributed to the edge of the rib 513.

Figure 7:
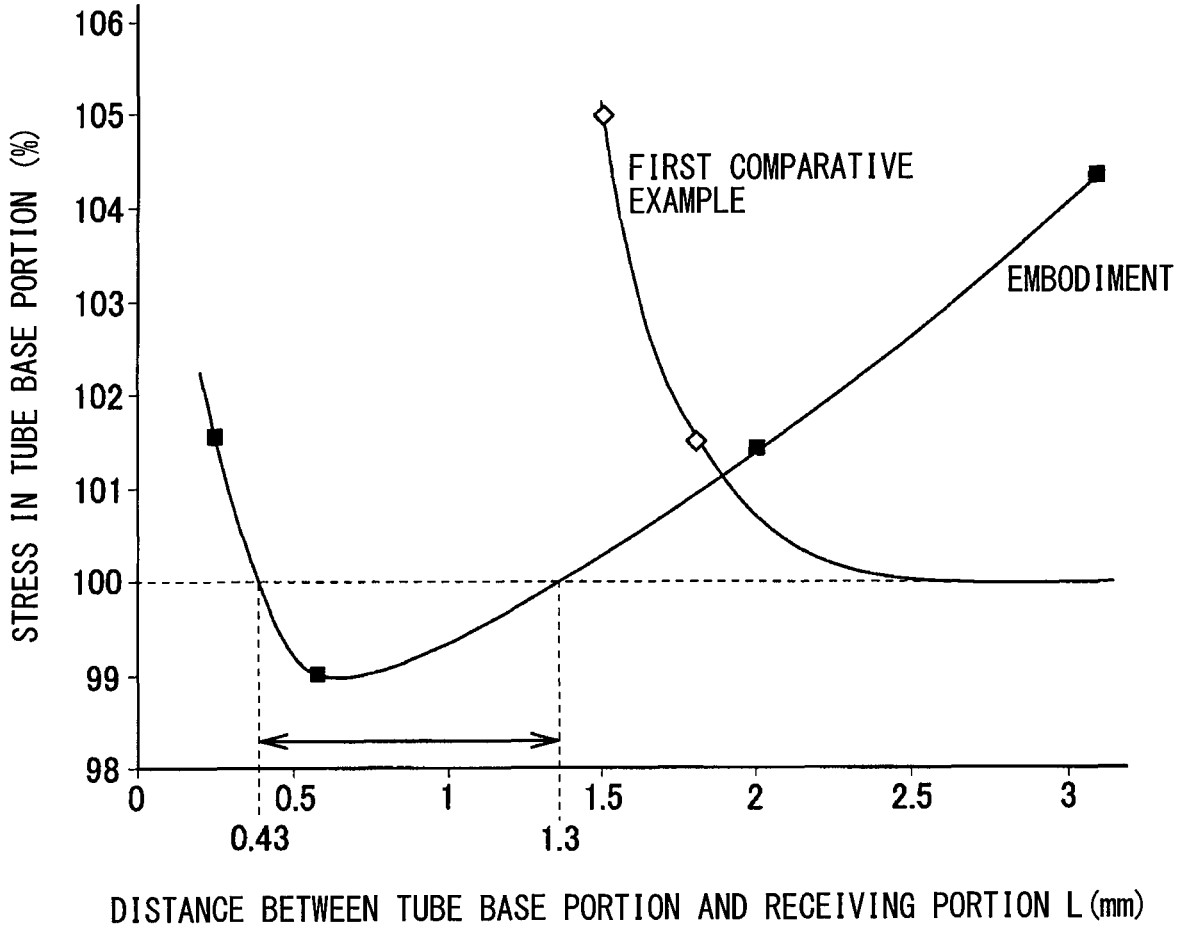
FIG. 7 is a graph showing a relationship between a distance between a tube connection surface and a receiving portion of the core plate and a thermal stress in the heat exchanger of the embodiment and a heat exchanger of a first comparative example.

FIG. 7 explains a relationship between the specified dimension L (referred to as the dimension L simply hereafter) between the receiving portion 512 of the core plate 51 and the tube 2 and stress caused in the connection area of the core plate 51 to which the tube 2 is connected. In a first comparative example shown in FIG. 7, the rib 513 is provided in the flat surface serving as the tube connection surface 511. The rib 513 of the first comparative example extends parallel to the tube width direction.

In the first comparative example, the tube connection surface 511 of the core plate 51 cannot define a sufficient space, which is required to distribute stress to the edge of the rib 513, when the dimension L decreases. As a result, stress which is caused in the tube base portion increases dramatically.

On the other hand, in the radiator 1 of the present embodiment, a distance between the tube base portion and the edge of the rib 513 decreases when the dimension L decreases. Therefore, the stress can be distributed to the edge of the rib 513 effectively. As a result, the inner wall 512*a* can be positioned adjacent to the tube 2, whereby a size of the radiator 1 in the tube width direction can be reduced, as compared to the first comparative example in which the rib 513 is provided in the flat surface of the tube connection surface 511. Therefore, according to the radiator 1 of the present embodiment, the inner surface of the tank body 52 is located between the lateral end of the tube 2 and the center portion of the tube 2 in the tube width direction.

In the radiator 1 of the present embodiment, a dimension between the tube base portion and the edge of the rib 513 increases when the dimension L is too large. As a result, the effect of reducing the stress deteriorates. When the dimension L is too small, a fillet geometry of the connection area becomes unstable when the tube 2 is brazed to the core plate 51. In addition, a shape of the core plate 51 becomes unstable since a pressing is required to be performed in a narrow space. As a result, the effect of reducing the stress deteriorates when the dimension L is too small.

Therefore, an appropriate range of the dimension L is set within a range that can obtain the effect of reducing the stress in the tube base portion, can secure the fillet geometry in the tube base portion to be stable, and can manufacture the core plate 51 stably. For example, the appropriate range of the dimension L is set larger than 0.43 millimeters and smaller than 1.30 millimeters ($0.43<L<1.30$) in the present embodiment. As shown in FIG. 7, the stress applied to the tube base portion becomes 100% when the dimension L is 0.43 millimeters and 1.30 millimeters.

Figure 8:
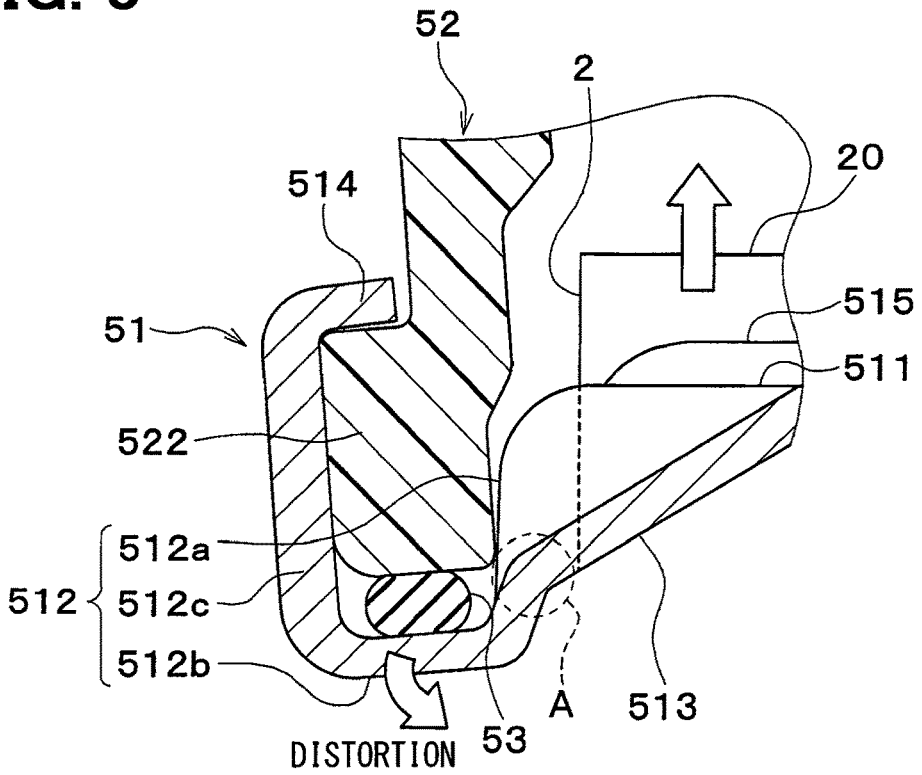
FIG. 8 is a cross-sectional view of a deformed core plate according to the embodiment.

Here, the tubes 2 extend along the tube longitudinal direction. Therefore, as shown in FIG. 8, the core plate 51 may be deformed to be curved when a temperature difference is caused between adjacent two tubes 2. According to the radiator 1 of the present embodiment, the rib 513 is connected to the portion (i.e., a connecting point A) of the inner wall 512*a*, which is located between the one end and the other end of the inner wall 512*a* in the tube longitudinal direction. As a result, the core plate 51 is bent at the connecting point A therefore a deformation of the core plate 51 is suppressed. Thus, even when a dimension of the tubes 2 is increased in the tube longitudinal direction, the protrusions 514, which are plastically deformed to fix the tank body 52 to the core plate 51, is not unfolded easily.

Figure 9:
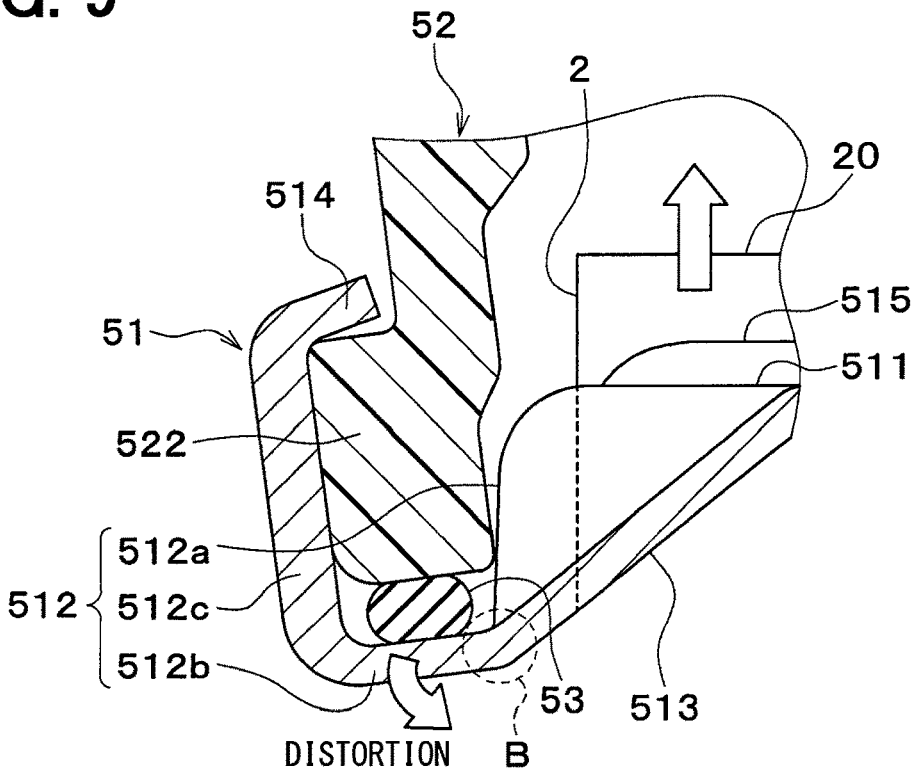
FIG. 9 is a cross-sectional view of a deformed core plate according to a second comparative example.

On the other hand, according to a second comparative example shown in FIG. 9 where the rib 513 is connected to the bottom wall 512*b*, the core plate 51 is easily deformed at a connecting point B where the rib 513 is connected to the bottom wall 512*b*. As a result, when a dimension of the tubes 2 is increased in the tube longitudinal direction, the protrusions 514, which are plastically deformed to fix the tank body 52 to the core plate 51, is unfolded easily. Therefore, the effect of reducing the stress deteriorates obviously.

Furthermore, in the radiator 1 of the present embodiment, the core plate 51 is not inclined with respect to the tube width direction in a connection area where the tube 2 is connected to the core plate 51. In other words, the core plate 51 is parallel to the tube width direction in the tube base portion. Therefore, the fillet geometry of the tube base portion can be stable when brazing the tube 2 to the core plate 51.

Figure 10:
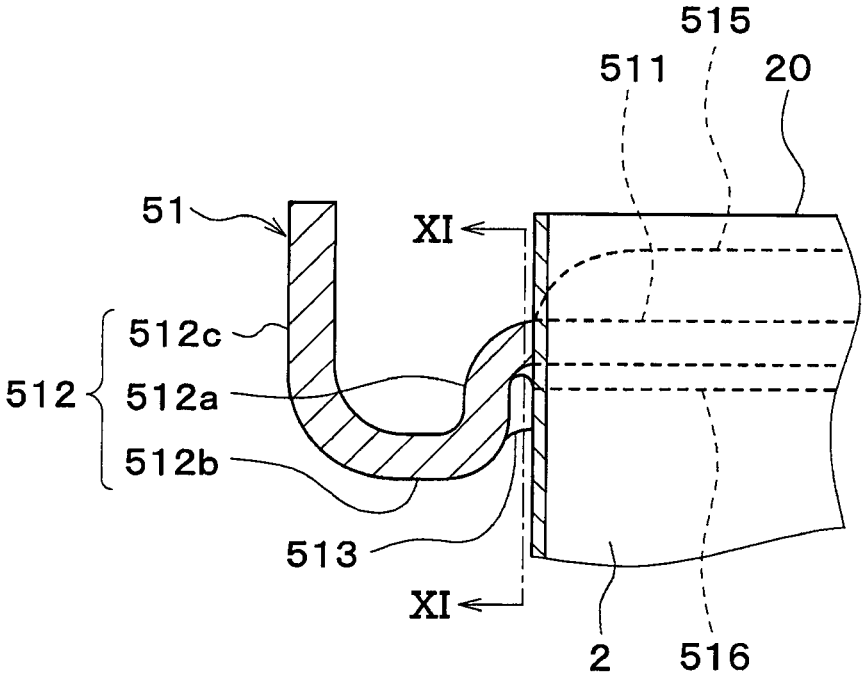
FIG. 10 is a cross-sectional view showing a fillet geometry of a connection area where tubes are connected to the core plate according to the embodiment.
Figure 11:
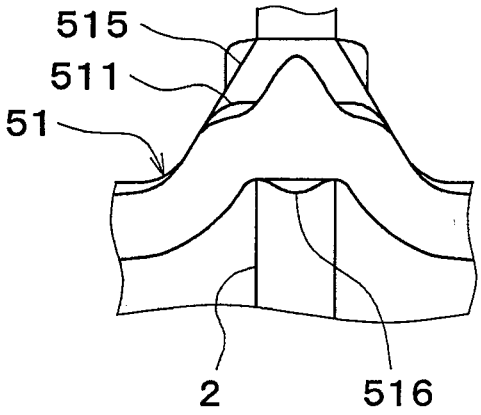
FIG. 11 is a cross-sectional view taken along a line XI-XI shown in FIG. 10.

Specifically, as shown in FIG. 10 and FIG. 11, in the radiator 1 of the present embodiment, the lateral end of the tube 2 is connected to a fillet 516 only near the connection area where the lateral end of the tube 2 is connected to the core plate 51. Accordingly, a height difference of the fillet 516 can be uniform. As a result, the stress can be distributed by forming the fillet geometry stable in the tube base portion where the stress is concentrated due to a thermal distortion.

Figure 12:
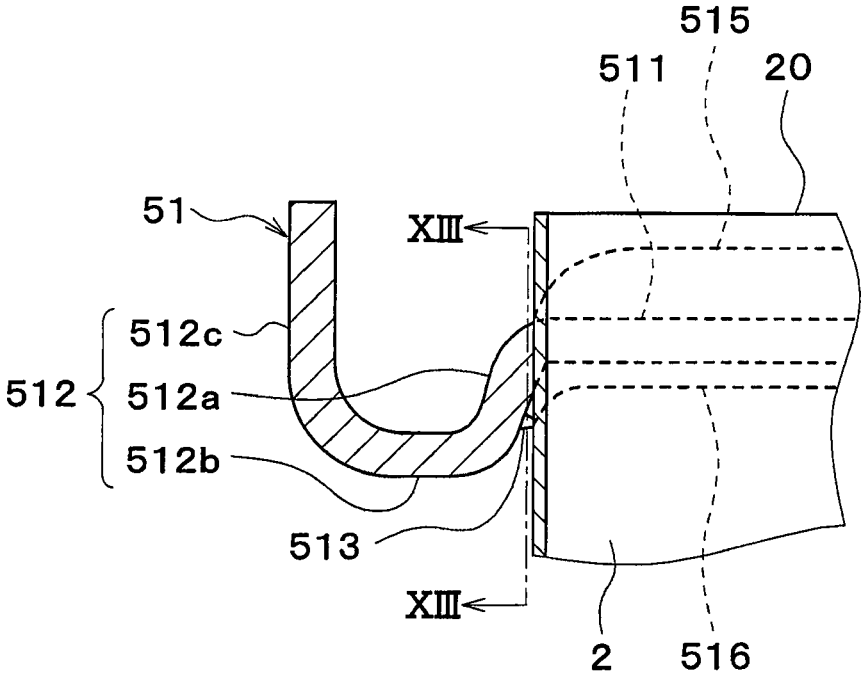
FIG. 12 is a cross-sectional view showing a fillet geometry of a connection area where tubes are connected to the core plate according to the second comparative example.
Figure 13:
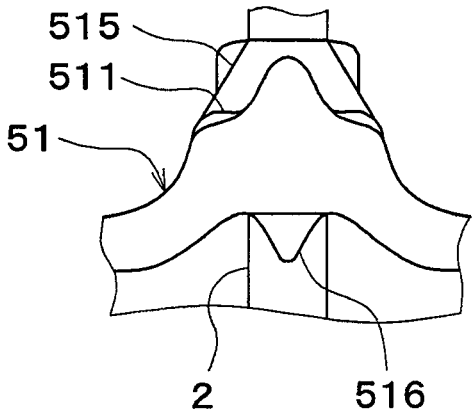
FIG. 13 is a cross-sectional view taken along a line XIII-XIII shown in FIG. 12.

In contrast, according to the second comparative example shown in FIG. 12 and FIG. 13 where the core plate 51 is inclined with respect to the tube width direction in the connection area in which the tube 2 is connected to the core plate 51, the fillet geometry of the tube base portion cannot be stable. That is, when the core plate 51 is inclined with respect to the tube width direction, the fillet 516 is formed to extend from the connection area toward the bottom wall 512*b* whereby the height difference of the fillet 516 increases. Thus, according to the second comparative example, the stress caused by thermal distortion is concentrated to the tube base portion and cannot be distributed.

Figure 14:
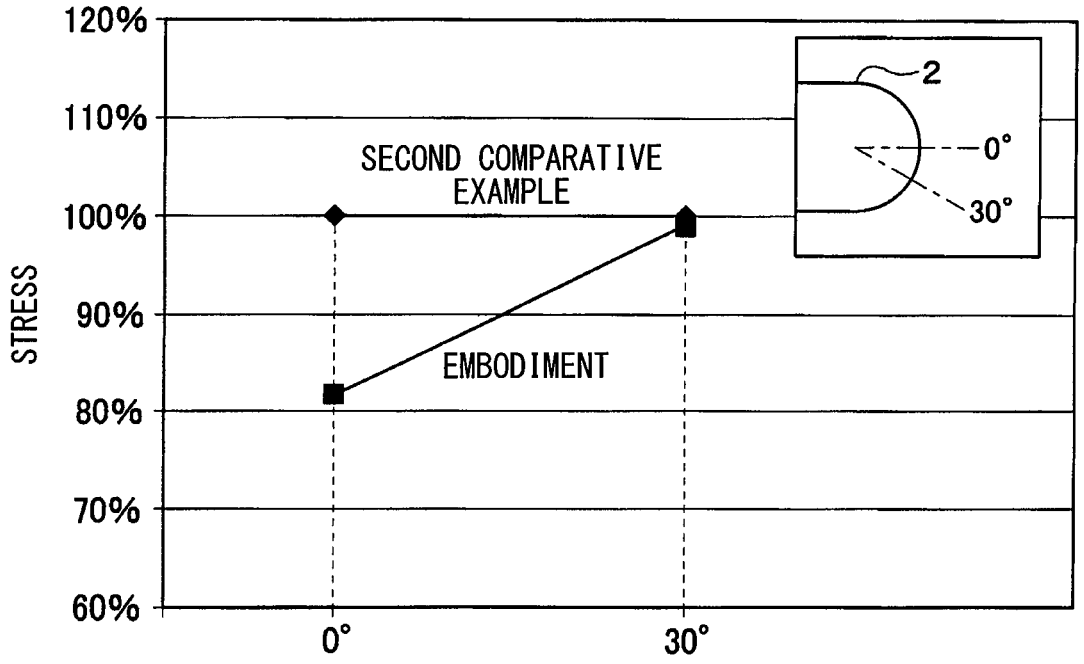
FIG. 14 is a graph showing stress applied to the radiator of the embodiment and the radiator of the second comparative example.

As shown in FIG. 14, the tube 2 includes a portion 30°. In the portion 30°, a degree of the stress caused in the present embodiment is similar to that caused in the second comparative example. In contrast, in the portion 0°, the degree of the stress caused in the present embodiment is reduced by 20% as compared to that caused in the second comparative example.

Modifications

While the present disclosure has been described with reference to preferred embodiments thereof, it is to be understood that the disclosure is not limited to the preferred embodiments and constructions. The present disclosure is intended to cover various modification and equivalent arrangements within a scope of the present disclosure. It should be understood that structures described in the above-described embodiments are preferred structures, and the present disclosure is not limited to have the preferred structures. The scope of the present disclosure includes all modifications that are equivalent to descriptions of the present disclosure or that are made within the scope of the present disclosure.

Figure 15:
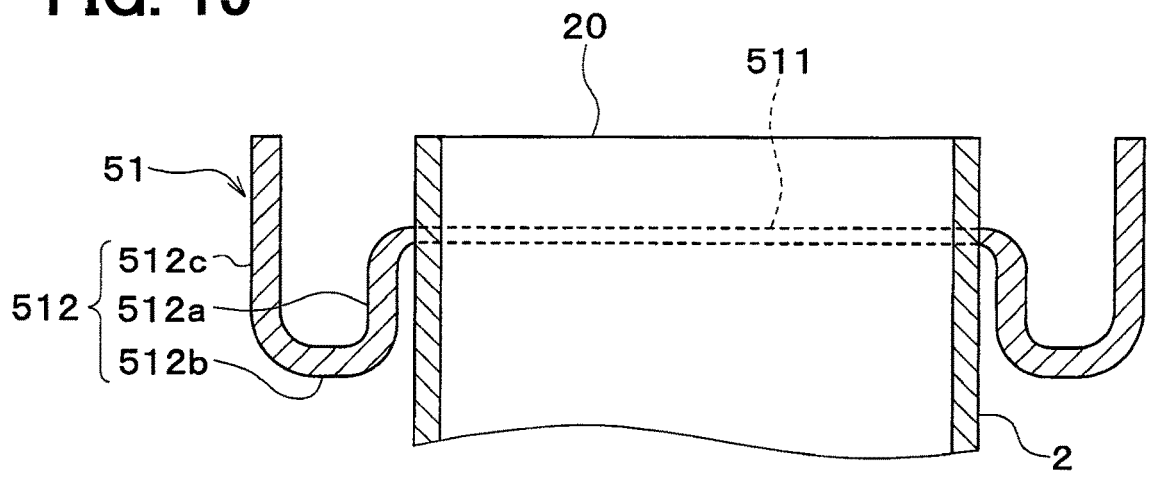
FIG. 15 is a cross-sectional view showing a modification of a connection area of the core plate where tube end portions are connected to the core plate.
Figure 16:
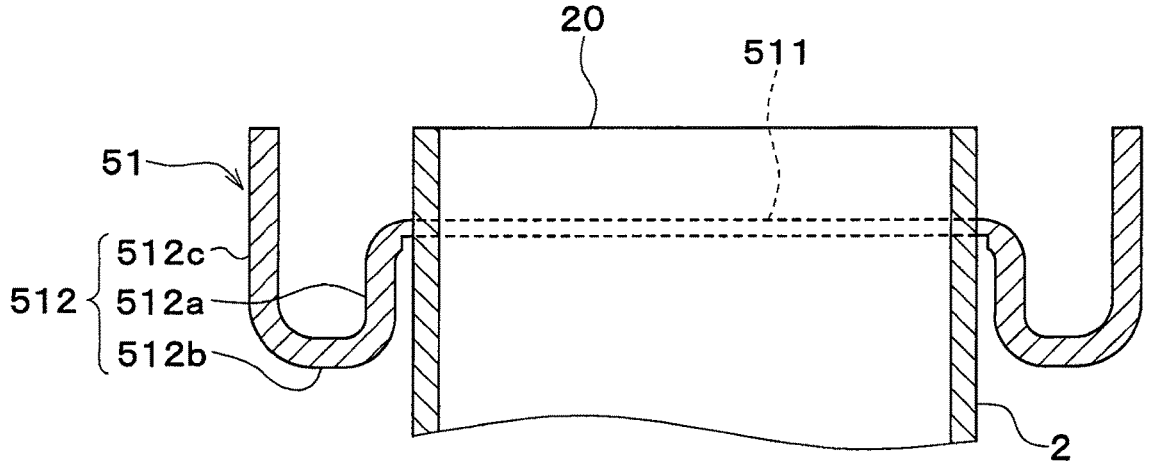
FIG. 16 is a cross-sectional view showing a modification of the connection area of the core plate where the tube end portions are connected to the core plate.
Figure 17:
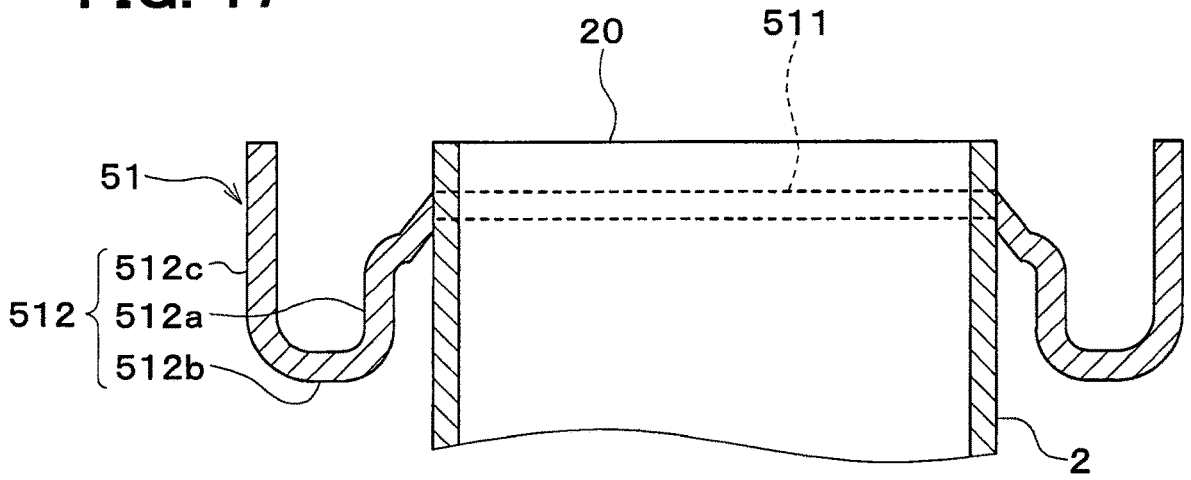
FIG. 17 is a cross-sectional view showing a modification of a connection area of the core plate where the tube end portions are connected to the core plate.

(1) The connection area of the core plate 51 where the lateral end of the tube 2 is connected to the core plate 51 may have a shape shown in FIG. 15, FIG. 16 or FIG. 17. The shapes shown in FIG. 15, FIG. 16 and FIG. 17 can be formed when forming the tube insertion holes 511*a* in the tube connection surface 511 of the core plate 51 by punching.

For example, a thickness of the core plate 51 is even in the above-described embodiment. However, a thickness of the core plate 51 may be thin in the connection area, where the lateral end of the tube 2 is connected to the core plate 51, as compared to that in other areas as shown in FIG. 15 and FIG. 16. For example, the thickness of the core plate 51 decreases gradually toward the tube connection surface 511 in the connection area where the lateral end of the tube 2 is connected to the core plate 51 as shown in FIG. 15. For example, the core plate 51 includes a step portion such that the thickness of the core plate 51 decreases in stages in the connection area where the lateral end of the tube 2 is connected to the core plate 51 as shown in FIG. 16. The configurations shown in FIG. 15 and FIG. 16 can provide the same effects as the above-described embodiment. By reducing the thickness of the core plate 51 in the tube base portion, the fillet geometry of the tube base portion can be more stable.

In the above-described embodiment, the core plate 51 is positioned to be parallel to the tube width direction in the connection area where the tube 2 is connected to the core plate 51. However, the core plate 51 may be inclined gently with respect to the tube width direction in the connection area where the tube 2 is connected to the core plate 51 as shown in FIG. 17. The configuration shown in FIG. 17 can provide the same effects as the above-described embodiment. According to the configuration shown in FIG. 17, the tubes 2 can be inserted into the tube insertion holes 511*a* easily.

Figure 18:
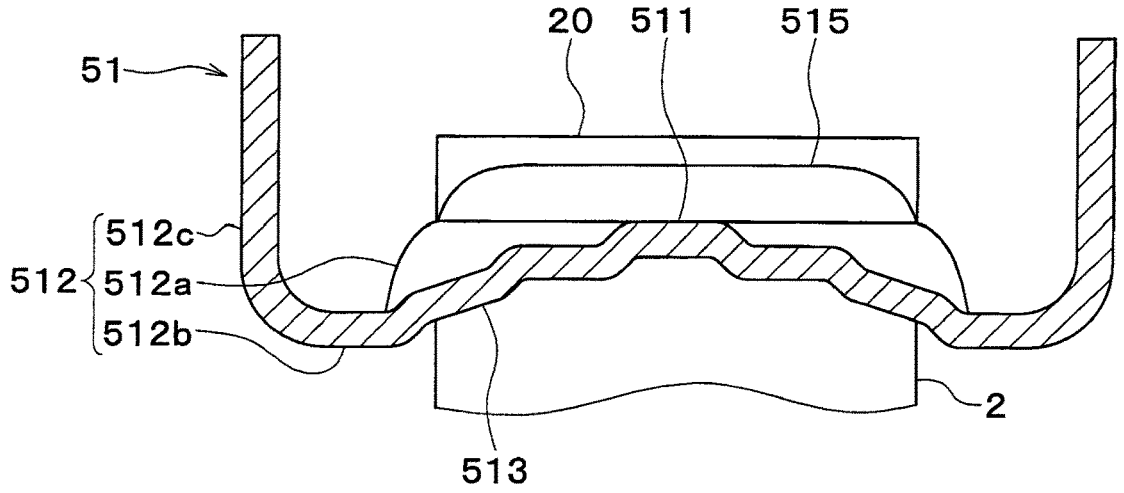
FIG. 18 is a cross-sectional view showing a modification of a rib provided with the core plate.
Figure 19:
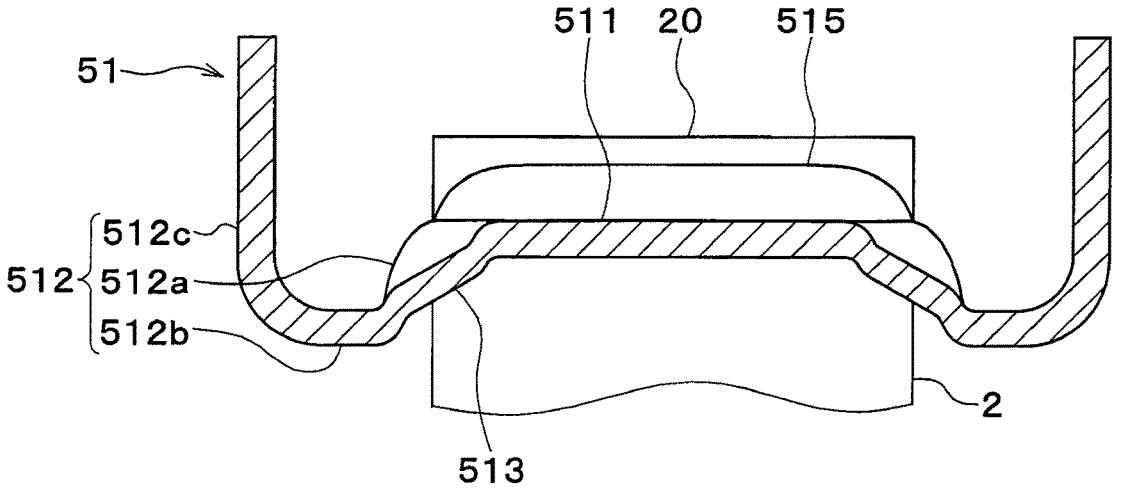
FIG. 19 is a cross-sectional view showing a modification of a rib provided with the core plate.
Figure 20:
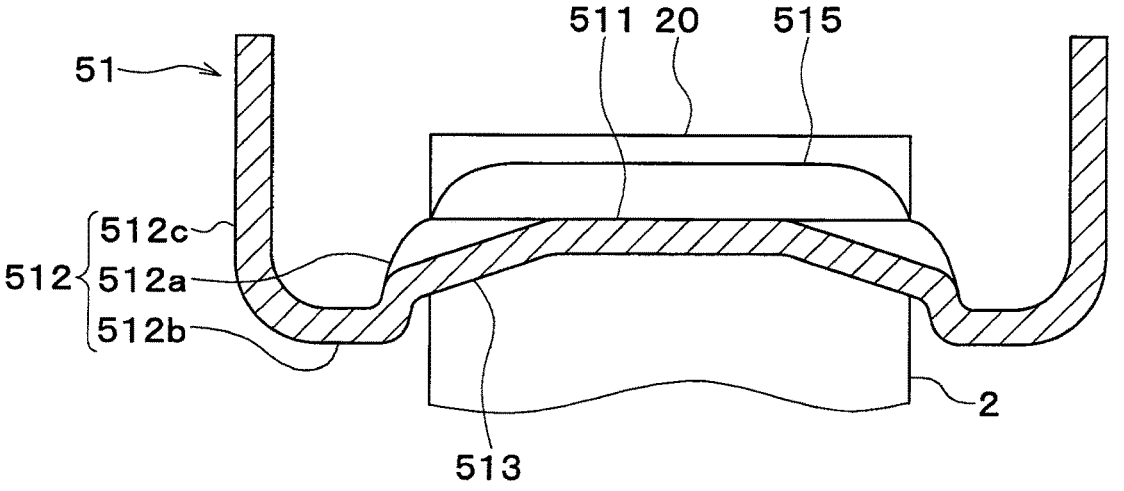
FIG. 20 is a cross-sectional view showing a modification of a rib provided with the core plate.

(2) The rib 513 of the core plate 51 may have a shape shown in FIG. 18, FIG. 19 or FIG. 20.

For example, the rib 513 may include a step portion as shown in FIG. 18. A quantity of the step portion may be more than one. For another example, a length of the rib 513 in the tube width direction may be shortened as shown in FIG. 19. For another example, a distance between the bottom wall 512*b* and the connecting point of the inner wall 512*a* where the rib 513 is connected to the inner wall 512*a* may be increased in the tube longitudinal direction as shown in FIG. 20. That is, an inclination angle of the rib 513 with respect to the tube width direction may be reduced as compared to that of the above-described embodiment.

(3) In the above-described embodiment, the heat exchanger of the present disclosure is applied to the radiator 1. However, the heat exchanger can be applied to another heat exchanger such as an evaporator and a refrigerant radiator (i.e., a refrigerant condenser).

(4) In the above-described embodiment, the gasket 53 is provided separately from the core plate 51 and the tank body 52. However, this is just an example. For example, the gasket 53 may be attached to one of the core plate 51 and the tank body 52 by a method such as gluing. Alternatively, the gasket 53 may be molded integrally with one of the core plate 51 and the tank body 52.

What is claimed is:

1. A heat exchanger comprising:

a plurality of tubes that are stacked and have a flat shape; and a header tank that is positioned on a side of the plurality of tubes in a longitudinal direction of the plurality of tubes, the header tank being in communication with the plurality of tubes, wherein the header tank includes a core plate that is coupled with longitudinal ends of the plurality of tubes and a tank body that is fixed to the core plate, the core plate includes a tube connection surface that includes a plurality of tube insertion holes corresponding to the plurality of tubes, the plurality of tubes being inserted into the plurality of tube insertion holes and brazed to the tube connection surface and a receiving portion that surrounds the tube connection surface and houses an end portion of the tank body which is located adjacent to the core plate, the receiving portion includes a bottom wall that faces the tank body across a gasket, the gasket being positioned between the tank body and the bottom wall to seal a gap therebetween, and an inner wall that extends from the bottom wall toward the tube connection surface, the tube connection surface and the inner wall are connected to a rib, which is located between adjacent two tubes of the plurality of tubes, the rib includes one end and an other end in a width direction of the plurality of tubes, the one end being connected to the tube connection surface, the other end being connected to the inner wall, the rib entirely sloping from the one end to the other end to separate away from the tank body and a tube end, the plurality of tubes include lateral ends in the width direction, and a clearance, which has a specified dimension, is defined between the inner wall and the lateral ends in the width direction, the specified dimension is larger than 0.43 millimeters and smaller than 1.30 millimeters, and the rib extends across the lateral ends of the tubes when viewed in a tube stacking direction.

2. The heat exchanger according to claim 1, wherein the core plate includes a connection area where the longitudinal ends of the plurality of tubes are connected to the core plate, and a thickness of the core plate in the connection area is smaller than that of the core plate in an other portion.

3. The heat exchanger according to claim 1, wherein the rib includes at least one step portion in the width direction.

4. The heat exchanger according to claim 1, wherein an inner surface of the tank body is located between lateral ends of the plurality of tubes and center portions of the plurality of tubes in the width direction.

* * * * *